US005596175A

United States Patent [19]

Ysbrand

[11] Patent Number: 5,596,175

[45] **Date of Patent: *Jan. 21, 1997**

[54] MOLDED CABLING, PREFORM FOR MAKING AND METHOD OF MAKING

[75] Inventor: Floyd Ysbrand, Joplin, Mo.

[73] Assignee: Esterline, Joplin, Mo.

[ * ] Notice: The term of this patent shall not extend beyond the expiration date of Pat. No. 5,331,115.

[21] Appl. No.: 382,111

[22] Filed: Feb. 1, 1995

[51] Int. Cl.[6] ..... H01B 7/08

[52] U.S. Cl. ..... 174/117 M; 174/117 F

[58] Field of Search ..... 174/117 M, 117 F, 174/117 R; 264/241; 139/425 R

[56] References Cited

U.S. PATENT DOCUMENTS

| | | | |
|---|---|---|---|
| 3,473,986 | 10/1969 | Hureau . | |
| 3,627,863 | 12/1971 | Fairbanks | 264/103 |
| 3,627,903 | 12/1971 | Plummer | 174/72 A |
| 3,758,359 | 9/1973 | Azuma | 156/244 |
| 3,909,508 | 9/1975 | Ross | 174/117 M |
| 3,928,519 | 12/1975 | Kashiyama et al. | 264/40 |
| 4,091,062 | 5/1978 | Nelson | 264/85 |
| 4,130,450 | 12/1978 | Bahder et al. | 156/48 |
| 4,429,179 | 1/1984 | Chynoweth | 174/117 M |
| 4,504,696 | 3/1985 | Piper | 174/32 |
| 4,801,764 | 1/1989 | Ohlhaber | 170/70 C |
| 4,808,771 | 2/1989 | Orr, Jr. | 174/72 R |
| 4,933,513 | 6/1990 | Lee | 174/115 |
| 4,956,524 | 9/1990 | Karkow | 174/117 M |
| 5,331,115 | 7/1994 | Ysbrand | 174/117 M |
| 5,367,122 | 11/1994 | de Olano | 174/48 |
| 5,437,831 | 8/1995 | Roose | 264/322 |
| B1 3,909,508 | 2/1987 | Ross | 174/117 M |

*Primary Examiner*—Kristine L. Kincaid
*Assistant Examiner*—Marc D. Machtinger
*Attorney, Agent, or Firm*—Lowe, Price, LeBlanc & Becker

[57] ABSTRACT

A molded cable comprises a plurality of conductors and a webbed conductor harness. The webbed harness has openings formed by intersecting strands, the strands including channels therethrough for the conductors. The webbed harness can be made in combination with the conductors or with a preform to form the channels. The preform can then be replaced by the conductors to form the molded cabling.

13 Claims, 5 Drawing Sheets

Figure 7
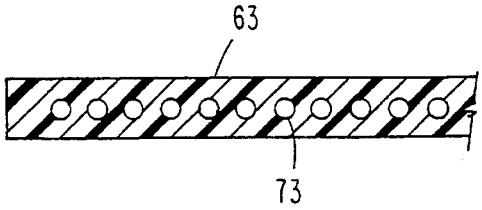
Figure 8
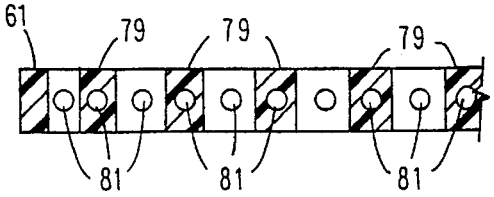
Figure 9
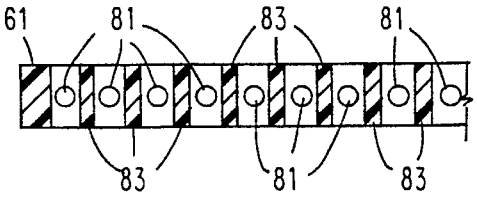
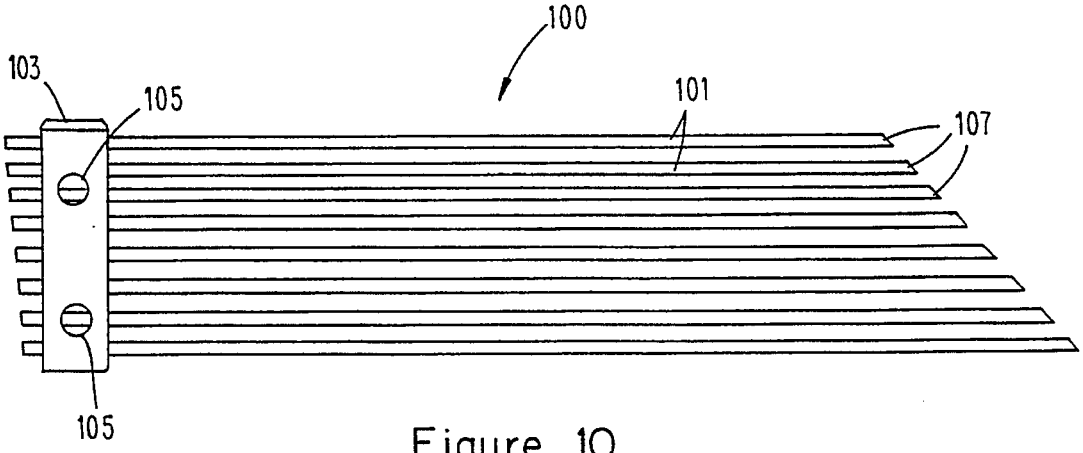
Figure 10

MOLDED CABLING, PREFORM FOR MAKING AND METHOD OF MAKING

FIELD OF THE INVENTION

The present invention is directed to a molded cabling, a method of making and a preform for use in the molded cable making method.

BACKGROUND ART

Electric cables come in a wide variety of shapes, types of conductors, number of conductors, insulation, and configurations. Electrical cables can be as simple as a single conductor with a simple insulator on the exterior of the conductor, or they can be very complex having multiple conductors of different sizes and different types with varying terminations or exit points along the length. The cabling can also have various termination devices on the ends of the conductors or they can be left bare, depending on the particular application.

Electrical cables of some sort are used in practically every device incorporating any electronics or electronic devices. Cabling is required to tie in the source of electricity to the electronics and to deliver and transfer electronic signals to other electronic device, to gauges, meters, lights or other visual indicators, to allow communications between devices and coordination of activities. Any time any type of electronic signals or current has to be delivered or transferred from one device to another electrical cables are generally in use.

Typically, when there are multiple signals or currents being transmitted between devices in most modern day apparatuses or machines, a custom electrical cable having multiple conductors and multiple terminations are made. Custom made electrical cables are used in automobiles, trucks, airplane, jets, rockets, other types of military apparatuses, computers, televisions, some telephones, stereos, and practically every other device imaginable employing any type of electronics.

In the past electrical cables have been made by several different configurations and methods. Typically, multiple conductors are contained within a sheath or covering. The sheath can be wrapped or molded by several different types of methods known in the art. Molding techniques result in a cable having multiple conductors surrounded by some sort of molding compound. The cable can be in one of several different configurations. The cable can be a flat ribbon, or round in the most common configurations. The multiple conductors can all run parallel to each other or they can be wrapped around each other in some sort of woven pattern, depending on the particular application and types of conductors.

In one instance of the prior art, electrical conductors are woven in a particular pattern such that the primary signal wire has non-signal carrying wires wrapped around it. This provides protection from interference from other signals. The non-signal wires can be current carrying conductors or ground conductors. The woven wires are then surrounded by an insulating material in most instances.

Particular applications having custom cabling often have conductors entering and leaving the cable at several different locations, with each having some sort of termination device. These type of cables are often prepared in some sort of jig designed specifically for the particular application. The wire are installed individually or in particular groups along the jig. Each of the wires or groups are added to the cable at particular locations leaving a sufficient length extending from the cable for a termination device and to enable the termination device to connect to some electrical apparatus. Once all the wires are in place, the cable is wrapped with an insulating material or subjected to a molding process where the cable is covered in the insulating material. The insulating material in the later often completely fills all voids between the wire and completely surrounds the wires forming an exterior insulating material around the cable.

The cabling of the prior art has several disadvantages. Once multiple conductors are included within a cable it is very difficult to make a repair to a single conductor. Typically, the cable outer insulating material has to be removed over a significant length to locate the problem and most be completely removed from end to end if the conductor has to be replaced. If the conductors are included in any sort of woven pattern, a single conductor typically can not be removed or repaired. If the conductor is included in any sort of molded sheath it may be impossible to remove or repair a single conductor without destroying the integrity of the cable.

Another disadvantage is the weight of the insulating material used in making the cable. Weight of the insulating material in some instances may actually exceed the weight of the conductors in the cable. Some applications where electrical cabling is used may be very critical. This is especially true in instances where the apparatus in which the cable is used has some sort of motion or locomotion, such as in automobiles, aircraft, spacecraft, and other military and non-military applications just to name a few.

U.S. Pat. No. 5,331,115 to Ysbrand discloses a molded cabling and a method of production which overcomes the disadvantages noted above. In this patent, a molded woven cabling is produced using injection molding techniques. That is, a plurality of wires or conductors are placed in a mold followed by an injection molding step which forms a harness around the conductors and the molded cable. One of the drawbacks associated with this process is that the conductors or wires used during the injection molding can be adversely affected by the injection molding step.

As such, a need has developed to provide an improved molding technique for making these types of molded cablings. In response to this need, the present invention, in one aspect thereof, provides a new and improved molding method using a preform which can be subsequently removed for insertion of the desired conductors. In another aspect, the present invention provides an improved harness structure for molded cabling.

SUMMARY OF THE INVENTION

Accordingly, it is an object of the present invention to provide a molded cabling and a method of production that is adapted to produce an electrical cable overcoming several disadvantages of the prior art.

Another object of the present invention is to provide a molded cable that is constructed to provide a cable in which the overall weight of the cable is significantly reduced compared to similar cables currently known in the art.

A further object of the present invention is to provide a molded cable in which a single conductor within the cable can be readily removed, repaired, or replaced without compromising the integrity of the entire cable.

Yet another object of the present invention is to provide a molded cable having a greater degree of flexibility.

A still further object of the present invention is to provide an improved method for making the molded cabling using a preform.

It is a further object of the present invention to provide a molded cable which utilizes a diamond-shaped webbing as the cable harness.

Other objects and advantages of the present invention will become apparent as a description thereof proceeds.

In satisfaction of the foregoing objects and advantages, the present invention comprises a molded cable having a plurality of conductors forming the cable, the conductors being positioned in spaced relationship with each other. The conductors are surrounded by a plastic-like molding compound molded into a web.

Alternatively, the web can be made with a series of channels therethrough for receiving the conductors after the web has been manufactured.

The web preferably comprises opposing end portions and side portions with a web portion extending therebetween. The web portion further comprises a plurality of strands, the strands extending between the opposing end portions and intersecting each other to form diamond shaped openings. At each intersection of a pair of strands is a channel permitting passage of at least one conductor therethrough.

In another aspect of the invention, a method of forming the molded cable includes the steps of providing a preform simulating a plurality of conductors, providing a mold having molding surfaces for receiving the preform and forming a web pattern. A molding compound is applied to the mold to form a molded cable harness surrounding the preform. The preform can then be removed from the molded cable harness, the preform removal leaving a series of longitudinally aligned channels in the web for conductor insertion. The preform is preferably made from a material which does not adhere to the molding compound when the cable harness is molded such as polyurethane or silicon of varying hardnesses.

In yet a further aspect of the invention, a preform is disclosed for use in making the inventive molded cables. The preform comprises a plurality of strands, each strand having a specified length and diameter. Also provided is a strand connector which is attached, preferably, transversely to the longitudinal orientation of the strands. In one embodiment, the strand connector is molded to the strands such that it surrounds them, the strand connector being arranged near an end of the strands. In use, the preform is placed in the mold prior to injection molding of the cable harness. The cable harness is molded therearound. Once the cable harness is cured and the mold is cooled to ambient temperatures, the cable harness/preform is removed from the mold and the preform is removed leaving hollow tunnels for receipt of desired conductors.

To accomplish the foregoing and other objects of this invention there is provided molded cabling and a method of production and more particularly to a cable for electrical conductors in which a plastic like material is molded in place around the individual conductors.

The above mentioned objects and other objects and features of the present invention will be better understood and appreciated from the following detailed description of the main embodiment thereof, selected for purposes of illustration and shown in the accompanying drawings.

BRIEF DESCRIPTION OF THE DRAWINGS

Reference is now made to the drawings of the invention wherein:

FIGS. 7–9 are cross-sectional views along the lines VII—VII, VIII—VIII and IX—IX of FIG. 6.

FIG. 10 is a top view of an exemplary preform of the invention.

DESCRIPTION OF THE PREFERRED EMBODIMENTS

Figure 3:
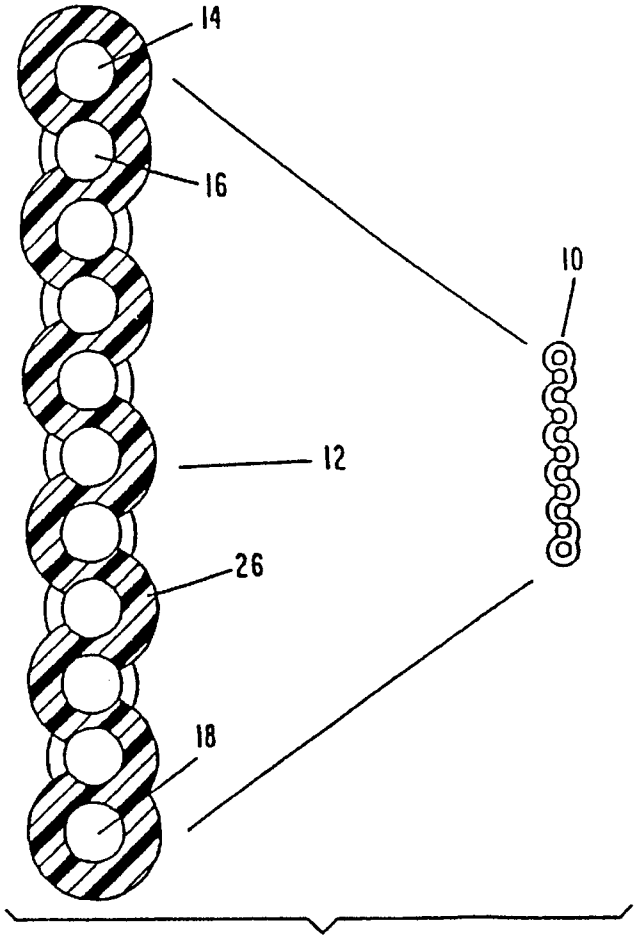
FIG. 3 is a sectional view of the molded cable.
Figure 1:
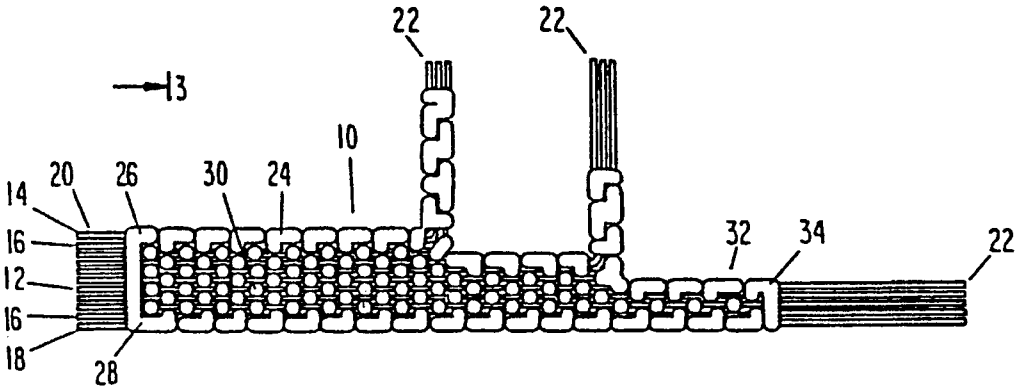
FIG. 1 is a top view of a molded cable showing a plurality of conductors with conductors exiting the cable at different location.
Figure 2:
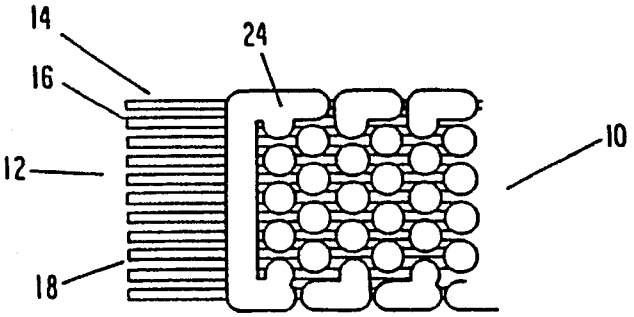
FIG. 2 is a bottom view of the beginning of the molded cable.

Referring now to the drawings, FIGS. 1 through 3, there is shown one preferred embodiment showing the principle characteristics for the molded cabling of the present invention. The molded cable 10 of this invention generally consists of a plurality of conductors 12 held in a space relationship by a woven plastic like compound 28.

The preferred embodiment and the best mode contemplated of the molded cabling and a method of production of the present invention are herein described. However, it should be understood that the best mode for carrying out the invention hereinafter described is offered by way of illustration and not by the way of limitation. It is intended that the scope of the invention include all modifications which incorporate its principal design features.

There can be as few as three conductors to an almost unlimited number of conductors included in the molded woven cabling 10 of this invention. Generally, the more conductors included the more complex the woven pattern becomes, especially if more than one layer is required. The conductors 12 can be generally referred to as a first conductor 14, second conductor 16, and continuing in this manner to a last conductor 18. The conductors 12 are held in a spaced relationship with each other by the plastic like compound 24 interlaced with the conductors 12 in a woven pattern 30. Preferably, the plastic like compound 24 is a molding compound which can be used in the molten state or can be a two part compound such as polyurethane with a curing agent.

For descriptive purposes, the woven pattern 30 of the plastic like compound can be described as a narrow strip 28 of the plastic like compound 24. However, in the preferred embodiment the narrow strips 28 are actually formed by a molding compound injected into a mold forming the woven pattern 30 along the entire length almost simultaneously. First, the plastic like compound 24 forms a beginning base 26 around the conductors 12 near the beginning end 20 of the molded woven cable 10. This secures all the ends 20 of the conductors 12 in a spaced relationship. The narrow strip 28 is then woven over the first conductor 14, under the second conductor 16, over the third conductor and continuing in this weaving pattern until the last conductor 18 is included. The narrow strip 28 is then woven around the last conductor 18 and woven back over the conductors 12 in the opposite manner to the first conductor 14 weaving the conductors together and securing them in a spaced relationship. The weaving pattern is repeated to an ending position 32. The narrow strip 28 then forms an ending base 34 around all the conductors 12 that terminate near the ending position 32.

The beginning base 26 and the ending base 34 secure all the conductors together to maintain the spaced relationship to each other at the beginning and end of the molded cable 10. Without the bases 26 and 34, the conductors 12 would be free to laterally move down to the first woven strip of the plastic like compound. This could result in weakening the structure of the molded cable at these locations.

Figure 4:
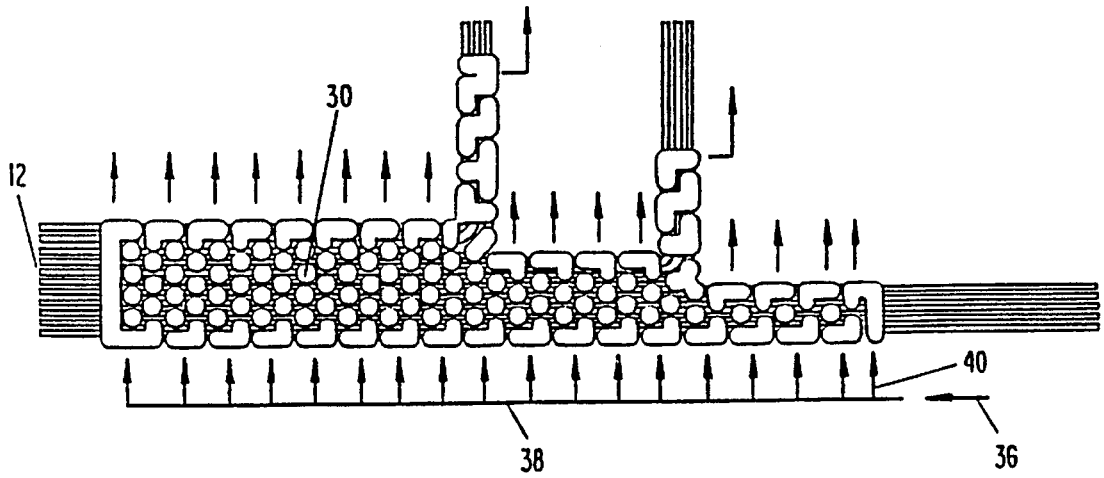
FIG. 4 is a representation of a mold holding a molded cable.

There are virtually unlimited configurations which can be made using the molded cable 10 of this invention and then method of production. As illustrated in FIGS. 1 and 4, there is a single beginning 20 and three separate ending locations 22. The exact configuration of the cable, the number and location of beginnings and endings, and the type of terminations would be determined by the particular application. The description and illustrations are not meant to limit the scope and application of this invention. There could be multiple entries and multiple exits in any given application. In addition, there could be multiple cables all configured differently in one apparatus.

Significant advantages are achieved by the molded cabling 10 of this invention. This includes; a greater flexibility, weight reduction, and repairability of conductors within the cable, just to name the most obvious. Since the conductors are not secured and totally secured within a sheath, either wrapped or molded, the conductors have more freedom to move. The conductors 12 can slide between the narrow strip 28 within the woven pattern 30. This allows the cable a greater amount of flexibility than other type of cabling known in the art.

Since the plastic like material only covers approximately half of the outer surfaces of the conductors 12 and the void areas between the conductors are not filled, only about half or less material is needed. Since only half the material is used the weight is significantly reduced.

Repairability of the conductors 12 within the molded cabling 10 is possible. This is due to the fact that the conductors 12 within the cabling 10 have the freedom to slide within the woven pattern 30 and about half of the outer surface of the conductors 12 can be observed. Therefore, the problem area can be readily observed and accessed. A single conductor, or more, can be pulled out of the woven pattern 30 and replaced back into the weave without destroying the integrity of the cable. This is not typically possible in the cabling currently known in the art. Typically, in the current art the sheathing has to be removed or split in order to observe and access a conductor contained within. Therefore, in most instances the entire cable is replaced rather then repaired.

As indicated above, the plastic like compound 24 is a molding compound in the preferred embodiment. As shown in FIG. 4, the woven pattern 30, in the preferred embodiment, is formed by an injection molding process although other suitable molding processes may be used. A primary injection port is represented by reference numeral 36. The molding compound is injected into the primary injection port 36 and flows down through an injection channel 38 to individual injection ports 40. In the preferred embodiment as shown, each individual injection port 40 forms two narrow strips 28 of the plastic like compound. In design all the individual injection ports 40, should be injecting the molding compound into the woven pattern 30 at the same time. Therefore, all the narrow strips 28 should be formed at about the same time.

The excess molding compound exits through exit ports 42 on the opposite side of the molded cable 10 from the individual injection ports 40. The molded cabling 10 should not be complete unless there is an excess coming out of all exit ports 42. This insures that all of the narrow strips 28 are completely formed before the mold 50 is removed.

Figure 5:
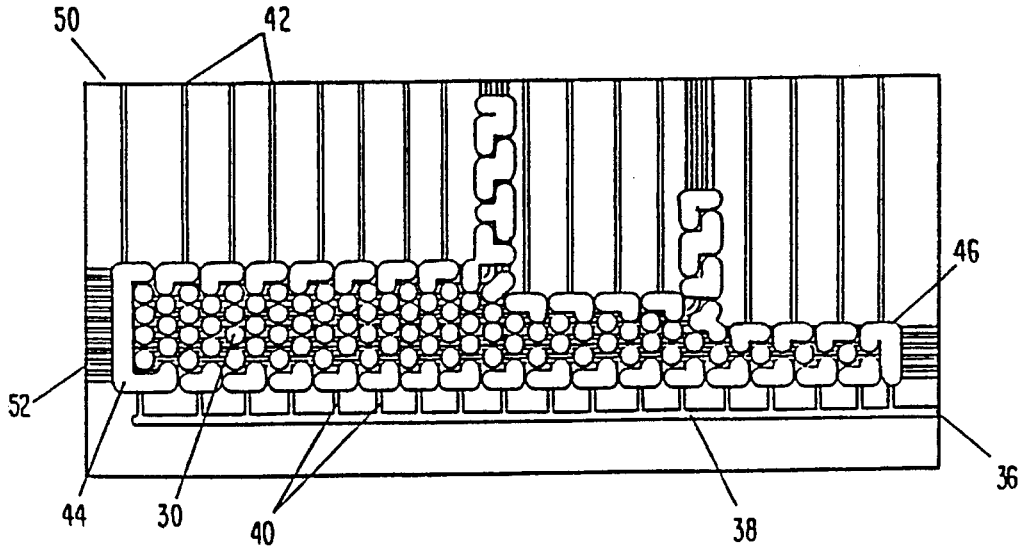
FIG. 5 is an illustration of a mold used to produce a molded cable of this invention.

The first step in the production of the molded cabling 10 of this invention is to create the mold 50, illustrated in FIG. 5. The mold 50 can be produced by any of several methods known in the art. The mold 50 will have slots 52, a woven pattern 30, injection ports 40 and exit ports 42. The slots 52 correspond to the size, number and desired configuration of the conductors 12 and the final cable 10 to be produced. The mold 50 will also have a primary injection port 36 for the receipt of the molding compound. In the preferred embodiment, there will be a primary injection port 36 leading to an injection channel 38. Individual injections ports 40 from the injection channel 38 will feed the woven pattern 30 at various points along the length. Typically, the points will corresponding to every other weave of the woven pattern. There will also be cutout area 44 for the beginning base 26 and cutout area 46 for the ending base 34.

Once the molds are complete, the next step would be to install the conductors 12 into the slots 52 and complete the assembly of the molds 52 with conductors 12 getting the assembly ready for the injection of the molding compound.

The molding compound would then be injected into the primary injection port 36 using any one of the injection processes known in the art. The molding compound would flow through the injection channel 38 into the individual injection ports 40 and into the woven pattern 30. Once the woven pattern 30 is completely filled, the excess molding compound would exit the exit ports 42.

Then depending on the particular molding compound, a curing cycle may be initiated to allow the molding compound to properly set and harden. Once properly cured the mold 50 can be removed leaving a molded cable 10. The excess and any flashing would have to be cleaned to provide the completed and finished product.

Figure 6:
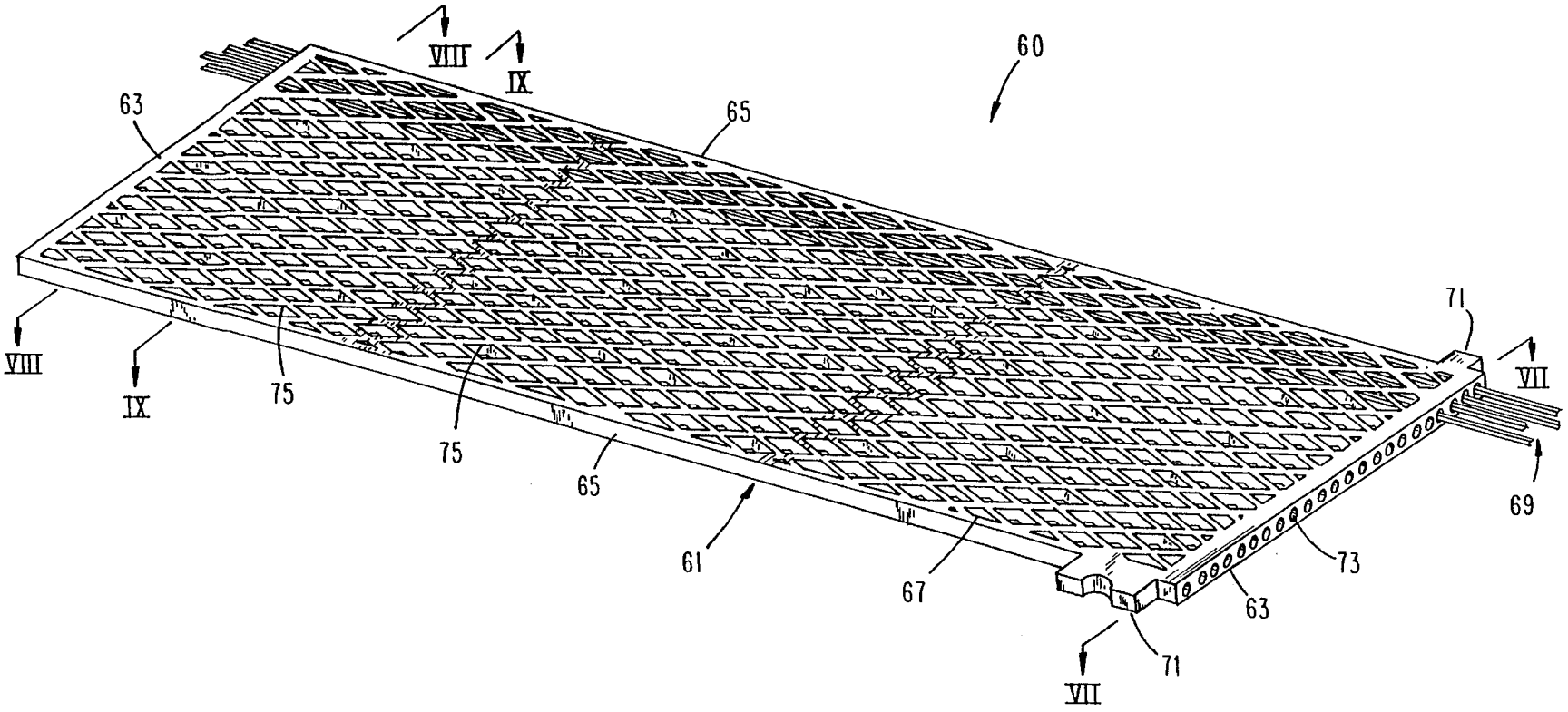
FIG. 6 is a perspective view of another embodiment of the invention showing a molded cable utilizing a web pattern.

With reference to FIG. 6, another embodiment of the inventive molded cabling is generally designated by the reference numeral 60 and includes a cable harness which may house one or more conductors as will be described hereinbelow.

The cable harness 61 has opposing end portions 63 and opposing side portions 65. Arranged within the periphery formed by the end and side portions is a web portion 67. The harness 61 may also have tabs 71 which facilitate mounting the harness for a given application. Other tab configurations may be used depending on the desired end use, the tabs being positionable anywhere on the harness.

With reference to FIGS. 6–9, the end portions 63 of the harness include spaced apart channels 73 which are sized to receive one or more wire conductors in each channel.

Figure 12:
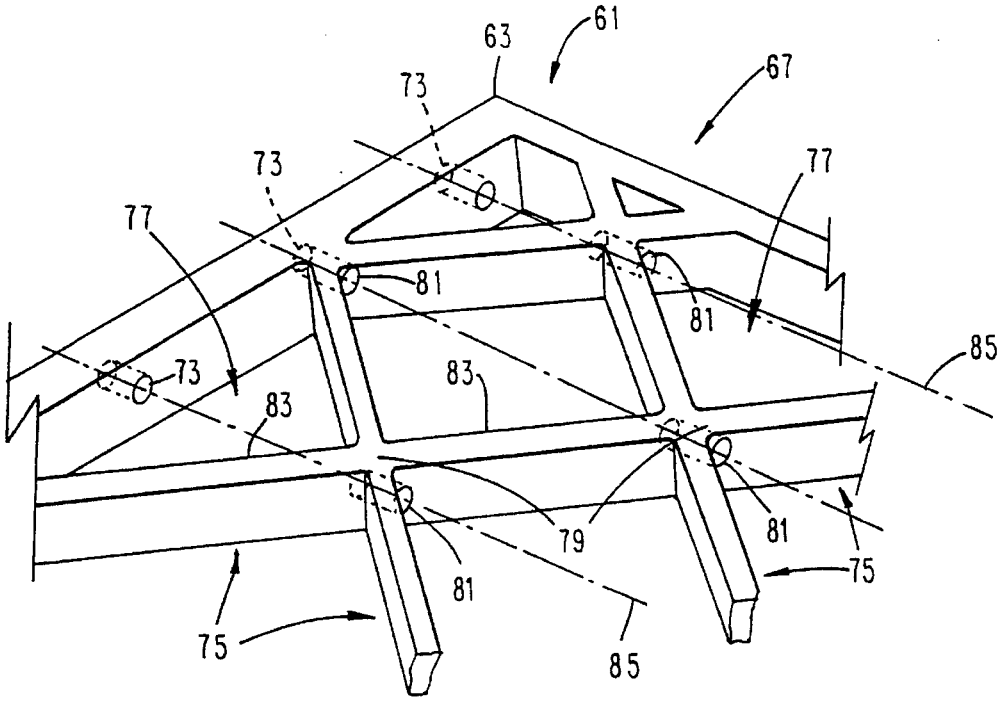
FIG. 12 is a perspective view of a portion of molded cable of FIG. 6 enlarged for greater detail.

Referring now to FIGS. 6 and 12, the web portion 67 is made of a series of strands 75 which extend within the periphery of the harness 61. Each strand 75 extends between an end portion and a side portion. The strands 75 are angled with respect to each other and the end and side portions 63 and 65 to form diamond shaped openings 77. In conjunction with formation of the diamond-shaped openings 77, the strands 75 form intersecting portions as designated by the reference numeral 79. At each of these intersecting portions is a channel 81 which is formed during the molding process and is sized to receive wire conductors for the finished molded cable.

By reason of the angulation of the strands 75 to form the diamond-shaped openings 77, each strand comprises a short segment 83 between adjacent intersecting portions 79 or one of the end or side portions of the harness 61. The cross-sectional views of the inventive harness in FIGS. 7–9 show the relationship between the segments 83, channels 61, and the intersecting portions 79. Within the scope of the present invention the openings 77 may have other shapes then diamond shapes, e.g. oval, square, or the like.

The channels 81 in the intersecting portions 79 and the channels 73 in the end portion 63 align to provide longitudinal passageways 85 through the harness 61 for one or more wire conductors. As described above, the cable harness 61 may be manufactured with the wire conductors already in the passages 85 or, alternatively, as will be described in greater detail hereinbelow, manufactured with a preform followed by preform removal and wire conductor insertion.

Figure 11:
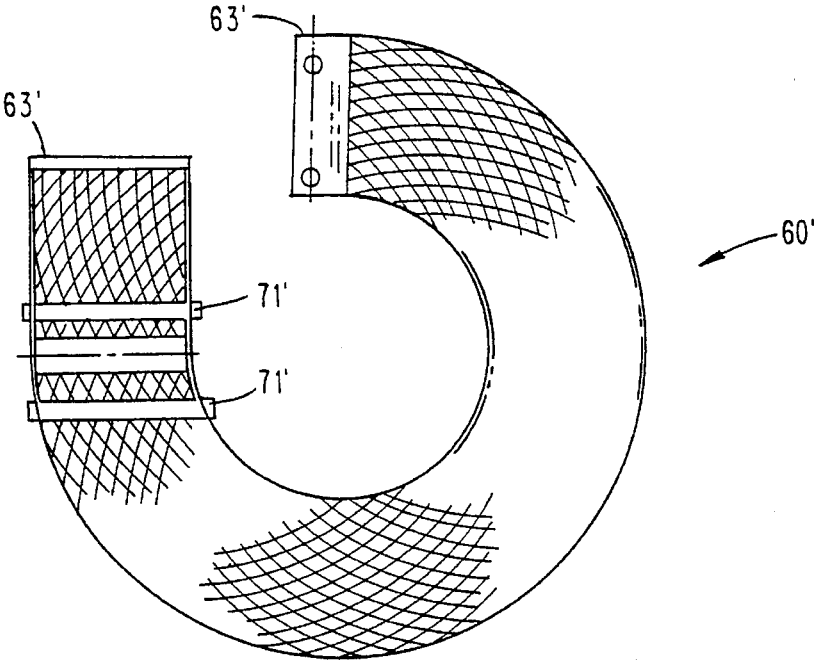
FIG. 11 is a top view of another embodiment of the molded cable using a web pattern.

FIG. 11 depicts an alternative configuration of the molded cable designated as reference numeral 60'. This configuration shows that different shapes or types of end portions 63' or tabs 71' can be used with the inventive molded cable depending on the desired end use. The molded cable 60' shown in FIG. 11 is also exemplary of the configuration of the mold surface used during molded cable manufacture. That is, the mold surface follows a generally circular path to form the molded cabling 60'.

When manufacturing the molded cabling 60 with conductors in place, the molding process for making the woven cabling described above can be followed. That is, the molded cabling 60 is formed with the conductors in place.

Alternatively, the cable harness 61 can be manufactured using a preform as shown in FIG. 10. In this method, the cable harness 61 is first formed by molding with the preform. The preform can then be removed and replaced with the desired number of conductors to form the molded cabling.

With reference to FIG. 10, an exemplary preform is generally designated by the reference numeral 100 and includes a plurality of preform strands 101. The preform strands are longitudinally aligned and joined by a strand connector 103. The strand connector 103 is preferably injection molded directly to the preform strands 101 when the preform is manufactured. The preform 100 is preferably molded out of a molding compound such as a plastic, e.g. polyurethane of various hardnesses, or a silicone of various hardnesses. Alternatively, the preform 100 can be a metallic material such as stainless steel with the strand connector being metallic or non-metallic and attached using conventional means. Likewise the strand connector could be metallic and the strands being non-metallic.

The strand connector 103 can include recesses 105 therein which facilitate positioning of the preform when used to form the cable harness 61.

It should be understood that the strand connector 103 can take any shape or configuration and be located at any point along the strand lengths. As shown in FIG. 10, the strands can increase successively in length so that when the preform 100 is used in a mold as depicted in FIG. 11, the preform strand ends 107 will terminate roughly in alignment with an end portion of the molded cabling 60'.

The preform 100 is preferably injection molded and can be molded such that the strands are all aligned longitudinally or, alternatively, formed in a circle similar to the configuration shown in FIG. 11.

In a method of forming the cable harness 61, a preform 100 is first positioned in the mold. Preferably, the mold comprises two mold halves with the preform arranged on one mold half initially. The other mold half is placed thereon, the two halves clamped together and injection molded with a molding compound such as polyurethane. Following filling the mold, the mold is placed in an elevated temperature oven to cure.

After curing is affected and the mold is cooled to ambient temperatures, the mold is opened and the cable harness and the preform combination is removed. The preform is then removed from the cable harness, this removal step leaving hollow tunnels or channels in the web portion 67 of the harness 61, see FIG. 12.

The desired electrical conductors are then inserted into the hollow channels to create the molded cabling comprising both the cable harness and electrical conductors. With the conductors in the harness, the wires are held in the position of zero stress and have not been exposed to any high temperatures since the preform has been used during the mold curing step. Thus, the wires have an extended life. Further, as described above, each and every wire is completely replaceable by removal from the cable harness followed by replacement of another wire or wires.

During the molding process, if necessary, a parting compound could be utilized to assure separation of the preform from the cable harness once the product is removed from the mold. It should also be understood that the web pattern formed in the molding process can have different cross-sectional shapes for the strands thereof. For example, the strands could be oval, circular or square in shape or rectangular as shown in FIG. 12. The dimensions of the web pattern can also be altered depending on the desired end use and the type of conductors being utilized in the molded cabling. For example, large diameter conductors would require web dimensions sufficient to form the channels for receiving the conductors. Likewise, the small diameter conductors can be accommodated with smaller dimensioned webs. In addition, any number of conductors can be utilized with the inventive molding cable and method of making. The preform can also accommodate any number of strands to coincide with a desired number of conductors for a given application.

The embodiment depicted in FIGS. 6–12 can incorporate any of the features described above for FIGS. 1–5.

As such, an invention has been disclosed in terms of preferred embodiments thereof which fulfill each and every one of the objects of the present invention as set forth hereinabove and provides a new and improved molded cable, method of making and preform for use with the inventive method.

Of course, various changes, modifications and alterations from the teachings of the present invention may be contemplated by those skilled in the art without departing from the intended spirit and scope thereof. Accordingly, it is intended that the present invention only be limited by the terms of the appended claims.

I claim:

1. A molded cable comprising a plurality of conductors forming said cable, said conductors being positioned in spaced relationship with each other; and a plastic like molding compound molded into a web around said conductors.

2. The molded cable of claim 1, in which said molding compound is silicone.

3. The molded cable of claim 1, in which said molding compound is polyurethane.

4. The molded cable of claim 1, wherein said web further comprises a) opposing end portions;

b) opposing side portions; and c) a web portion extending between said opposing end and side portions and around said conductors.

5. The molded cable of claim 4, wherein each said opposing end portion has holes therethrough for passage of at least one of said conductors.

6. The molded cable of claim 4, wherein said web portion further comprises a plurality of strands, said strands extending between said opposing end and side portions and intersecting each other to form openings, each intersection of a pair of said strands including a channel for passage of at least one of said conductors therethrough.

7. The molded cable of claim 4, wherein said plastic like molding compound is a silicone or polyurethane.

8. A molded cable harness comprising a web having opposing end portions, opposing side portions and a web portion extending between said opposing side and opposing end portions, said web portions having a plurality of longitudinally aligned channels therethrough for receiving conductors, said web made of a plastic like molding compound.

9. The molded cable of claim 8, wherein each said opposing end portion has holes therethrough for passage of at least one of said conductors.

10. The molded cable of claim 8, wherein said plastic like molding compound is a silicone or polyurethane.

11. The molded cable harness of claim 8 further comprising a preform, a portion of said preform arranged in said longitudinally aligned channels.

12. The molded cable harness of claim 11, where said preform further comprises:

a) a plurality of preform strands, each preform strand having a specified length and diameter;

b) a strand connector molded to said plurality of preform strands, said strand connector arranged near an end of the plurality of preform strands; and c) wherein said plurality of preform strands and said strand connector are made from a metallic or non-metallic material and wherein each said preform strand is in a respective one of said longitudinally aligned channels.

13. The molded cable harness of claim 12 wherein said metallic material is stainless steel and said non-metallic material is silicone or polyurethane.

* * * * *